US006116663A

United States Patent [19]

Robert

[11] Patent Number: 6,116,663

[45] Date of Patent: Sep. 12, 2000

[54] CASKET LOCK

[75] Inventor: Pascal Robert, Norbertville, Canada

[73] Assignee: Cercueils Vic Royal, Inc., Victoriaville, Canada

[21] Appl. No.: 09/175,085

[22] Filed: Oct. 19, 1998

[51] Int. Cl.[7] ..... E05C 1/04

[52] U.S. Cl. ..... 292/153; 292/241; 292/304; 292/DIG. 11; 27/DIG. 1

[58] Field of Search ..... 27/DIG. 1; 292/153, 292/240, 241, 304, DIG. 11; 70/38 A, 39, 37

[56] References Cited

U.S. PATENT DOCUMENTS

| | | | |
|---|---|---|---|
| 2,323,674 | 7/1943 | Purkiss | 292/157 |
| 2,417,756 | 3/1947 | Hillenbrand | 292/157 |
| 4,987,753 | 1/1991 | Kuo | 70/39 |
| 5,331,830 | 7/1994 | Su | 70/38 R |
| 5,457,861 | 10/1995 | Lloyd | 27/10 |
| 5,589,459 | 12/1996 | Bullock et al. | 70/224 |

FOREIGN PATENT DOCUMENTS 154804 10/1938 Austria .

*Primary Examiner*—Darnell M. Boucher
*Assistant Examiner*—John B. Walsh
*Attorney, Agent, or Firm*—St. Onge Steward Johnston & Reens LLC

[57] ABSTRACT

A lock of the catch type adapted to use in combination with a casket is disclosed. The lock includes a locking pin and a receiving element. The locking pin in installed on the lid of the casket and has a portion configured so to enable it to engage and remain engaged, when so desired, in the receiving element of the lock. The receiving element is installed in one of the side walls of the casket so that it is directly opposite to the locking pin. The receiving element comprises a hollow cylinder case adapted to be inserted and rotate with respect to a sleeve. The hollow cylinder case and the sleeve each comprises an opening for receiving the corresponding portion of the locking pin. The receiving element further including a compressible O-ring for enabling the hollow cylinder case to be inwardly biased against the sleeve during locking and unlocking of the lock.

13 Claims, 4 Drawing Sheets

CASKET LOCK

FIELD OF THE INVENTION

The present invention relates to locks adapted to be installed in caskets. More precisely, the present invention is concerned with a lock of the catch-type which is easy to install on the casket and easy to use.

DESCRIPTION OF PRIOR ART

It is well known to use locks in caskets for locking the lid of same. However, the locking means commonly used are often difficult to manipulate, as they provide no means to indicate whether or not the casket is locked. Further more, some of the locks are indiscreet in that they are quite noisy and require a special key to activate them.

In addition, because of the fact that some caskets are made of wood and that they constitute essentially of a five-sided open box, they may warp or be easily deformed. This in turn, may cause a misalignment of the lid with respect to the four walls of the casket which in turn may render locking of same difficult. As a result, it may be difficult to close the casket properly.

Ball catch locks such as those comprising a miter joint connector and a connecting bolt are commonly known and used. However they are not reliable locking means as the miter joint connector is not tightly fastened to the supporting member on which it is installed. As a result it easily falls out of place when the connecting bolt is released therefrom. Indeed, in most locks of the ball catch type such as previously described, the joint connector is loosely attached to the supporting member.

SUMMARY OF THE INVENTION

Hence, in order to prevent such inconvenience, it is an object of the present invention to provide a locking mechanism that is easy and simple to use. More precisely, the present invention is concerned with a lock of the catch-type, comprising:

an engaging member comprising a locking pin;

a receiving member having an inner and an outer end, the receiving member comprising:

a female element in the form of a sleeve, said sleeve having a central axis and comprising an opening lying in a plane parallel to said central axis and on a periphery of said female element, said sleeve further comprising an elongated slot on a portion thereof, said elongated slot lying in a plane perpendicular to said central axis and having a predetermined length delimited by an upper and a lower end, at least one of said end comprising a recess extending in the direction of said outer end of said receiving member;

a male element having an inner end and an outer end, said inner end being formed as a hollow cylinder case adapted to be inserted within said female element, said male element adapted to rotate with respect to said female element about an axis parallel to said central axis, said hollow cylinder case being provided with a pear-shaped opening having a wider and a thinner portion, said pear-shaped opening lying in a plane normal to said central axis for receiving said locking pin, said hollow cylinder case comprising a hole for receiving aspring pin, said spring pin having a plane perpendicular to said central axis, said outer end of male element including a keyway;

biasing means for outwardly biasing said male element with respect to said female element;

said lock having an open position and a closed position, said lock being in said open position when said wider portion of said pear-shaped opening of said male element and said opening of said female element are in registration for receiving said locking pin, and said spring pin is set into said recess of said upper end, said lock being in said closed position when once said locking pin is engaged within said male element, said male element is pushed inwardly through said keyway so to release said spring pin out of said recess into said elongated slot and said keyway is further rotated at a predetermined position so that said locking pin is engaged with said thinner portion of said pear-shaped opening of said male element and said spring pin is engaged in said lower end.

It is also an object of the invention to provide a lock that allows proper alignment of the locking pin in the corresponding receiving member of the lock.

It is a further object of the invention to provide a lock that comprises means to indicate the locking or unlocking position of the lock.

Finally, it is also an object of the present invention to provide a casket comprising at least one lock according to the present invention so to provide locking means that appears discreet on the casket.

BRIEF DESCRIPTION OF THE DRAWINGS

In order that the invention may be more clearly understood and more readily carried into effect the same will now, by way of example, be more fully described with reference to the accompanying drawings.

BRIEF DESCRIPTION OF THE INVENTION

Figure 1:
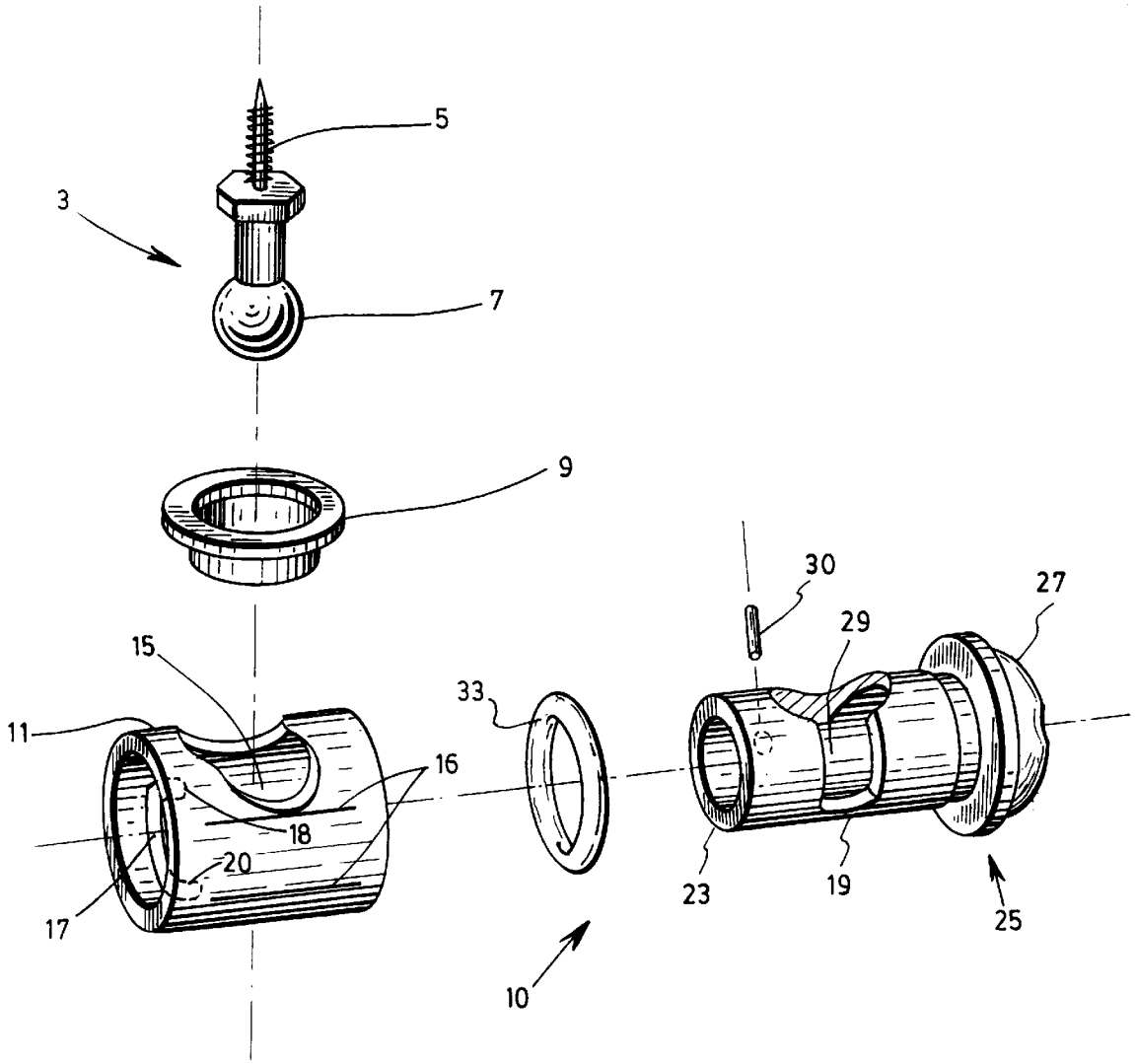
FIG. 1 is an exploded view of a lock according to a preferred embodiment of the invention.

As can be seen in FIG. 1, the lock (1) according to a preferred embodiment of the present invention comprises a locking pin (3) and a corresponding receiving member (10).

The locking pin (3) has two extremities one of which is provided with an attaching means such as a threaded rod (5) for fixing the locking pin in place. The other extremity is provided with an enlarged portion such as a knob (7) adapted to engage in the opening of the corresponding receiving member (10) of the lock (1). As can be seen, the locking pin (1) is preferably a ball head screw.

The receiving member (10) of the lock (1) comprises a female element (11), a male element (19), a ring (33) and a spring pin (30).

The female element (11) consist essentially of a sleeve (13) and is defined by a central axis. The female element comprises an opening (15) lying in a plane which is upper and parallel to said central axis. The female element (11) also comprises an elongated slot (17) having a plane perpendicular to the central axis. The elongated slot (17)

comprises an upper and a lower end, each of said end comprising a recess (18, 20) extending in the direction of the outer end (25) of the receiving member (10). It is well understood that the elongated slot may comprise a single recess located at either end of the elongated slot, although it is preferred that both recesses be present. This embodiment will not affect the functioning of the lock. It is well understood that the elongated slot (17) may only comprise one single recess located at either end of said elongated slot although it is preferred that both recess be present. This embodiment will not affect the functioning of the lock (1). The sleeve (13) may further comprise on its periphery, a plurality of projections (14) for keeping the receiving member tightly secured in place in the wall (39) of the casket (35) during operation of same. The projections have a plane parallel to the central axis. Preferably, the sleeve (13) comprises four projections.

The male element (19) comprises a hollow cylinder case (21) which is delimited by an inner (23) and outer end (25). The hollow cylinder case (21) is adapted to be inserted within the female element (11) and to rotate with respect to the latter. The hollow cylinder case (21) comprises a general pear-shaped opening (29) having a wider and a thinner portion and lying in a plane normal to the central axis. The thinner portion of the pear-shaped opening may be defined by a somewhat rounded or squared contour. The hollow cylinder case (21) further comprises a hole (31) for receiving the spring pin (30) in a plane perpendicular to the central axis. The spring pin is preferably a quarter inch (¼") long and 3⁄32 inch wide. The outer end (25) of the hollow cylinder case (21) is defined by a keyway (27). The keyway (27) is adapted to be used in combination with an Allen key.

As can also be seen in FIG. 1, the lock (1) further comprises a ring (33). The ring (33) is made of a resistant and compressible material such as polyurethane, polypropylene and buna "N". The ring (33) is installed in such a position so that during locking and unlocking of the lock (1), the ring (33) will act as a biasing means. More precisely, during locking, the ring will enable the male element (19) to be inwardly biased against the female element (11) so to move the projection out of the recess (18) of said upper end thereby releasing same in the elongated slot. This in turn, allows the male element (19) to rotate to a predetermined amount, preferably about a quarter turn, with respect to the female element (11), thereby driving the spring pin in the recess (20) of the lower end. This, in turn, will produce a clicking sound as a result of the spring pin (30) being clashed against the edge of the recess (20).

During unlocking of the lock (1), the male element (19) is rotated back to its initial position thereby engaging the spring pin (30) in the recess (18) whereby the ring (33) is simultaneously decompressed. This in turn will produce a clicking sound as a result of the projection (31) being clashed against the edge of the recess (18) under the decompression force of the ring (33). Hence, the ring (33) which acts as a biasing means is a central characteristic of the present invention since it enables the locking/unlocking mechanism to occur. The biasing means may be of different form such as a spring.

Hence, in order to interact with the receiving member (10) of the lock (1), the locking pin (3) is installed at a precise position opposite to it. More particularly, for use in combination with a casket, the locking pin (3) may be installed on the lid of same. The receiving member (10) is installed on one of the wall (39) so that it is in registration with the locking pin. In other words, the receiving member is installed so that the opening of the female and male (11, 19) elements are directly opposite to the locking pin (3) and the keyway (27) is facing the outer face of the wall (39).

Figure 2:
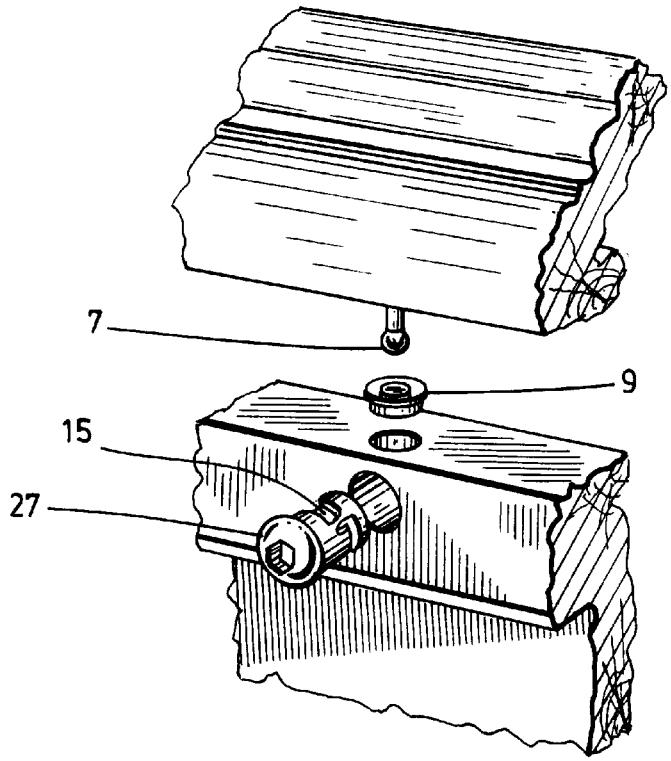
FIG. 2 is a perspective view of the assembled lock of FIG. 1 in an open position.

In the open position as shown in FIG. 2, the opening (15) of the female element (11) is in registration with the wider portion of the pear-shaped opening (29) of the male element (19). The spring pin (30) is located at one end of the elongated slot (17). More precisely, it is engaged in the recess (18) of the upper end of the elongated slot (17). As can be seen, the ring (33) is decompressed.

Figure 3:
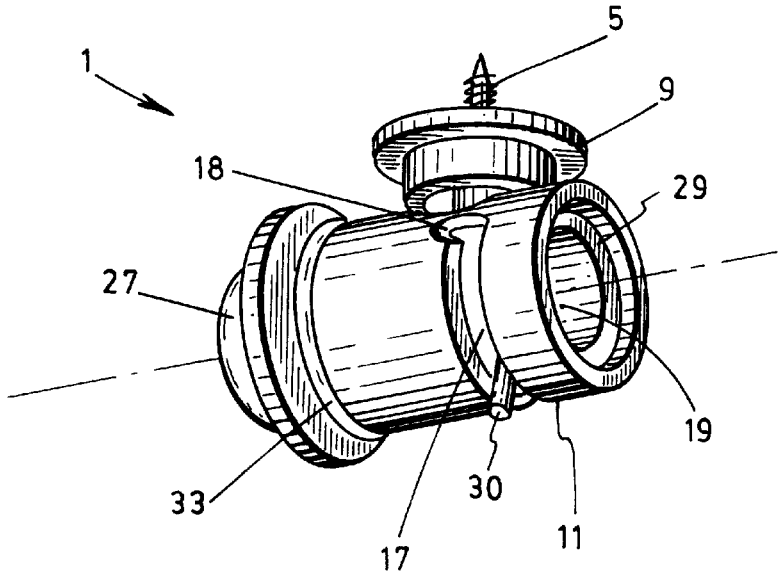
FIG. 3 is a perspective view of the lock of FIG. 1 in an intermediary position from open to locked position.

For fastening the lock (1), an Allen key is inserted within the keyway (27) of the male element (19). As can be seen in FIG. 3, the male element (19) is pushed inwardly against the female element (11) so to release the spring pin (30) from the recess (18) of the upper end. The ring (33) is therefor compressed. Fastening of the lock (1) occurs when once the male element (19) is biased against the female element (11), it is rotated at a predetermined position preferably about 90° in respect with the female element (11). As a result, the spring pin is released in the recess (20) of the lower end and the male element (19) rotates in respect with the female element (11) until the thinner portion of the pear-shaped opening (29) of the male element (19) is in registration with the opening (15) of the female element (11), therefore maintaining the locking pin (3) engaged within the receiving member (10) of the lock (1). Indeed, the locking pin (3) remains engaged within the receiving member (10) when the knob (7) of the locking pin (3) is trapped within the thinner portion of the pear-shaped opening of the male element (19).

Figure 4:
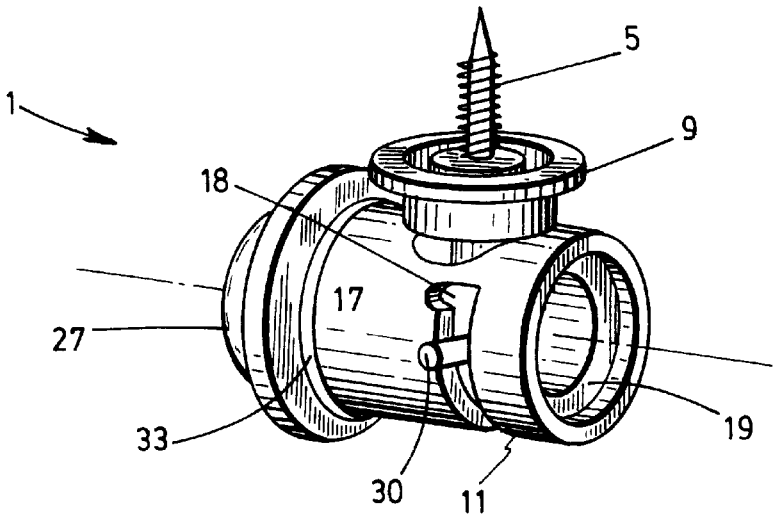
FIG. 4 is a perspective view of the lock of FIG. 1 in the locked position.

In FIG. 4, the lock (1) is in the locked position and the biasing means that is the ring (33), is compressed. The spring pin (30) is driven to the end of the elongated slot (17) opposite to the recess-end.

In a preferred embodiment, the lock may further comprise a guide (9) which can be installed on top of the opening (15) on the female element (11). Preferably, the guide (9) is a T-shaped sleeve. An object of the guide (9) is to realign or facilitate the alignment of the knob (7) of the locking pin (3) inside the opening (15) of the receiving member of the lock (1) and to protect the hole on the wall (39) of the casket (35) in cases where the lid is misaligned with the casket (35).

Figure 5:
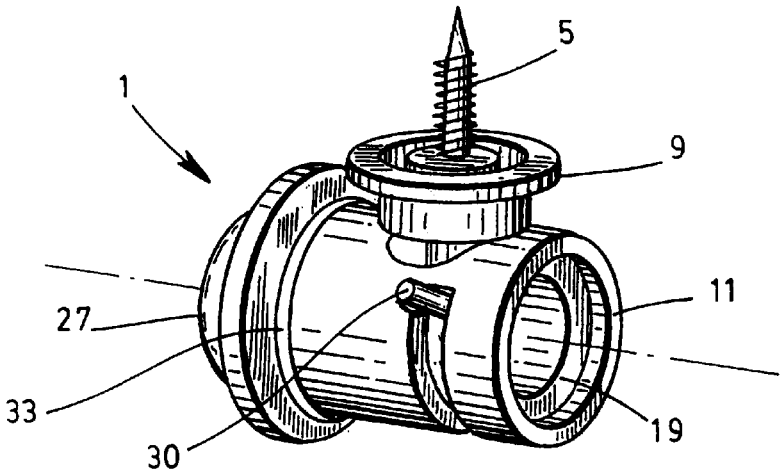
FIG. 5 is a perspective view of a casket comprising a lock according to the present invention.
Figure 6:
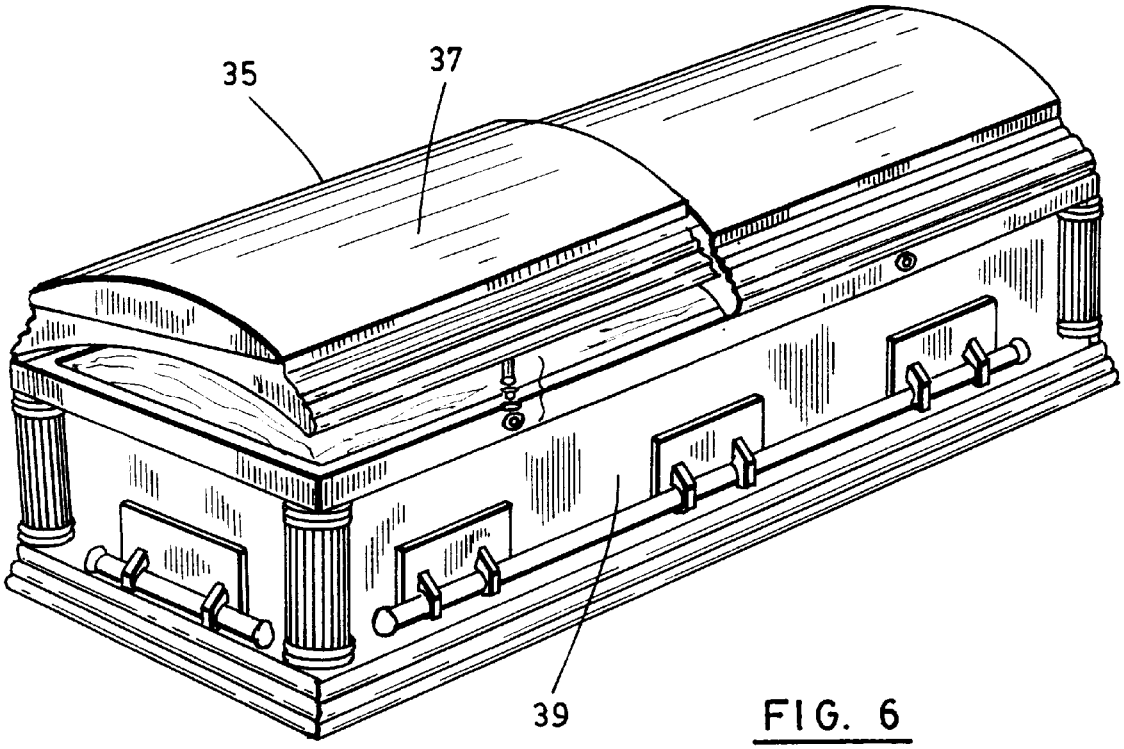
FIG. 6 is a perspective view of a casket bearing the lock of FIG. 1.

As shown in FIG. 5, the lock (1) of the present invention may be used in combination with a casket (35) for locking the lid of same. It is worth mentioning that a casket may contain more than one lock. Such is the case of caskets having a lid composed of two halves wherein each half can operate independently.

As can also be appreciated, the lock according to the present invention can be used in combination with a compartment on the casket such as fall front type drawers.

Although preferred embodiments of the invention have been described in detail herein and illustrated in the accompanying drawings, it is to be understood that the invention is not limited to these precise embodiments and that various changes and modifications may be effected therein without departing from the scope or spirit of the invention.

I claim:

1. A lock of the catch-type comprising:

an engaging member comprising a locking pin;

a receiving member having an inner and an outer end, the receiving member comprising:

a female element in the form of a sleeve, said sleeve having a central axis and comprising an opening lying in a plane parallel to said central axis and on a periphery of said female element, said sleeve also comprising an elongated slot on a portion thereof, said elongated slot lying in a plane perpendicular to said central axis and having a predetermined length delimited by an upper and a lower end, at least one of said end comprising a recess extending in the direction of said outer end of said receiving member;

a male element having an inner end and an outer end, said inner end being formed as a hollow cylinder case adapted to be inserted within said female element, said male element adapted to rotate with respect to said female about an axis parallel to said central axis, said hollow cylinder being provided with a pear-shaped opening having a wider and a thinner portion, said pear-shaped opening lying in a plane normal to said central axis for receiving said locking pin, said hollow cylinder case comprising a hole for receiving a spring pin, said spring pin having a plane perpendicular to said central axis for engagement into said elongated slot, said outer end of male element including a keyway;

biasing means for outwardly biasing said male element with respect to said female element;

said lock having an open position and a closed position, said lock being in said open position when the wider portion of said pear-shaped opening of said male element and said opening of said female element are in registration for receiving said locking pin, and said closed position when once said locking pin is engaged within said male element, said male element is pushed inwardly through said keyway so to release said spring pin out of said recess of said upper end into said elongated slot and said keyway is further rotated at a predetermined position so that said locking pin is engaged with the thinner portion of said pear-shaped opening of said female element and said spring pin is driven into said lower end of said elongated slot.

2. A lock according to claim 1, wherein the sleeve comprises at least one projection on its periphery for maintaining in place the receiving member during operation of the lock, said projections lying in a plane parallel to said central axis.

3. A lock according to claim 2, wherein the lock further comprises a T-shaped sleeve installed in registration with the opening located on the female element, so as to facilitate entrance of the locking pin into the receiving member of the lock.

4. A lock according to claim 3, wherein the locking pin comprises a first and a second end, said first end comprising an attaching means, said second end comprising an enlarged portion in the form of a knob.

5. A lock according to claim 4, wherein the locking pin is a ball head screw.

6. A lock according to claim 5, wherein the biasing means consist of a compressible ring.

7. A lock according to claim 6, wherein the ring is made of buna "N".

8. A lock according to claim 7, wherein the keyway is configured so as to be used in combination with an Allen key.

9. In combination, a casket having four side walls, a lid adapted to pivot between an open and a closed position and at least a lock of the catch-type, the lock comprising:

an engaging member comprising a locking pin, the locking pin being installed on the lid;

a receiving member having an inner and an outer end, the receiving member being installed in registration with a locking pin on one of said corresponding wall, the receiving member comprising:

a female element in the form of a sleeve, said sleeve having a central axis and comprising an opening lying on a plane parallel to said central axis and on a periphery of said female element, said sleeve further comprising an elongated slot on a portion thereof, said elongated slot lying in a plane perpendicular to said central axis and having a predetermined length delimited by an upper and a lower end, at least one of said end comprising a recess extending in the direction of said outer end of said receiving member;

a male element having an inner end and an outer end, said inner end being formed as a hollow cylinder case adapted to be inserted within said female element, said male element adapted to rotate with respect to said female element about an axis parallel to said central axis, said hollow cylinder case being provided with a pear-shaped opening having a wider and a thinner portion, said pear-shaped opening lying in a plane normal to said central axis for receiving said locking pin, said hollow cylinder case comprising a hole for receiving a spring pin, said spring pin having a plane perpendicular to said central axis for engagement into said elongated slot, said outer end of male element including a keyway;

biasing means for outwardly biasing said male element with respect to said female element;

said lock having an open position and a closed position, said lock being in said position when the wider portion of said pear-shaped opening of said male element and said opening of said female element are in registration for receiving said locking pin, and said spring pin is set into said recess of said upper end, said lock being in said closed position when once said locking pin is engaged within said male element, said male element is pushed inwardly through said keyway so to release said spring pin out of said recess of said upper end into said elongated slot and said keyway is further rotated at a predetermined position so that said locking pin is engaged with the thinner portion of said pear-shaped opening of said male element and said spring pin is driven in said lower end of said elongated slot.

10. A lock according to claim 9, wherein the sleeve comprises at least on projection on its periphery for maintaining in place the receiving member in said wall of said casket, said projection lying in a plane parallel to said central axis.

11. A lock according to claim 10, wherein the lock further comprises a T-shaped leeve installed in registration with the opening located on the female element, so as to facilitate entrance of the locking pin into the receiving member of the lock.

12. A lock according to claim 11, wherein the locking pin comprises a first and a second end, said first end comprising an attaching means, said second end comprising an enlarged portion in the form of a knob.

13. A lock according to claim 12, wherein the locking pin is a ball head screw.

* * * * *